US006139448A

United States Patent [19]

Sullivan

[11] Patent Number: 6,139,448

[45] Date of Patent: Oct. 31, 2000

[54] GOLF BALL WITH ELEVATED DIMPLE PORTIONS

[75] Inventor: Michael J. Sullivan, Chicopee, Mass.

[73] Assignee: Spalding Sports Worldwide, Inc., Chicopee, Mass.

[21] Appl. No.: 09/182,233

[22] Filed: Oct. 30, 1998

[51] Int. Cl.[7] ..... A63B 37/14

[52] U.S. Cl. ..... 473/384; 473/383; 473/377

[58] Field of Search ..... 473/384, 383

[56] References Cited

U.S. PATENT DOCUMENTS

| | | |
|---|---|---|
| 922,773 | 5/1909 | Kempshall . |
| 1,418,220 | 5/1922 | White . |
| 4,787,638 | 11/1988 | Kobayashi . |
| 5,916,044 | 6/1999 | Shimosaka et al. ..... 473/384 |

*Primary Examiner*—Jeanette Chapman
*Assistant Examiner*—Raeann Gorden
*Attorney, Agent, or Firm*—Laubscher & Laubscher

[57] ABSTRACT

A new dimple configuration for the surface of a golf ball is characterized by a portion extending above the surface of the ball. Each dimple includes an annular portion having an inner diameter and an outer diameter, and a circular portion having a diameter corresponding with the annular portion inner diameter. Either, the annular portion of the circular portion is convex and elevated relative to the ball surface with the other portion being concave and extending below the ball surface. When a struck ball travels through the air, the elevated portions trip air at the ball surface to improve the flight characteristics of the ball.

14 Claims, 3 Drawing Sheets

FIG. 2
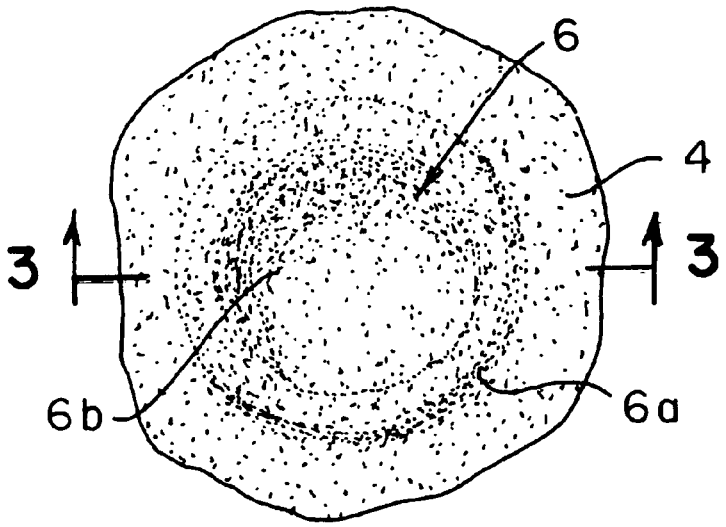
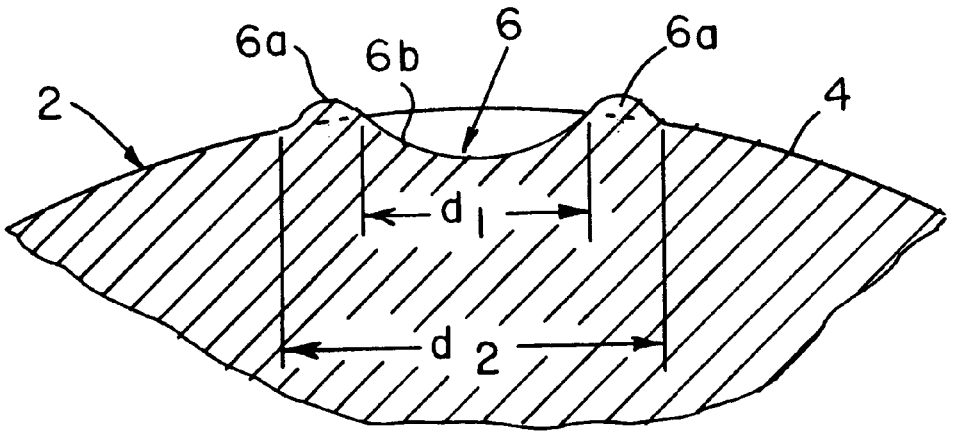
FIG. 3

FIG. 4
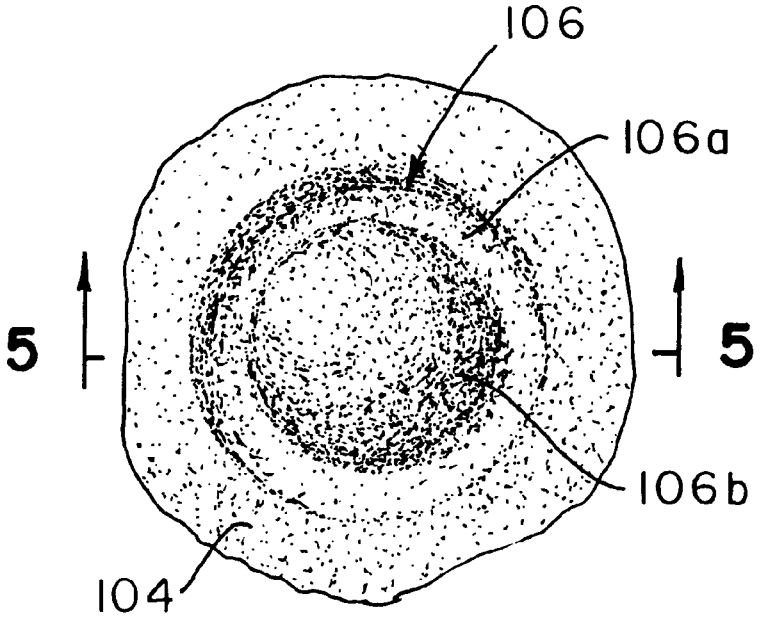
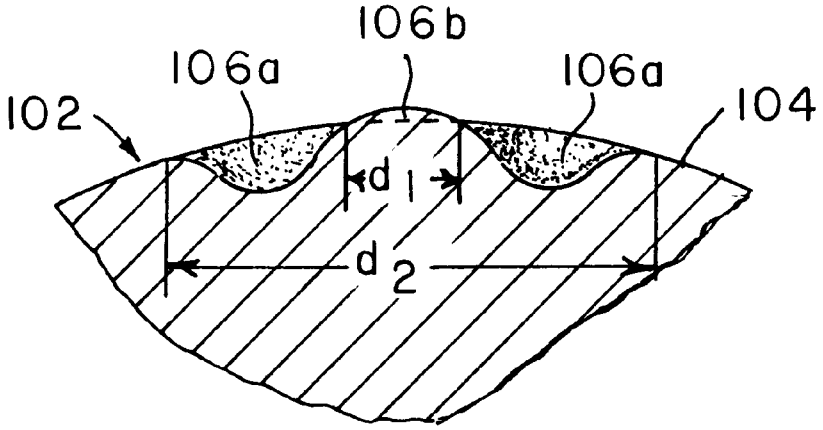
FIG. 5

GOLF BALL WITH ELEVATED DIMPLE PORTIONS

BACKGROUND OF THE INVENTION

The present invention relates to a new configuration for the dimples on a golf ball surface which improve the flight characteristics of the ball.

According to United States Golf Association (U.S.G.A.) rules, a golf ball may not have a weight in excess of 1.620 ounces or a diameter smaller than 1.680 inches. The initial velocity of balls conforming to U.S.G.A. regulations may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a struck golf ball will travel in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

Drag on a golf ball is also reduced by forming a plurality of dimples, generally circular, in the outer surface of the ball. The dimples serve to reduce the pressure differential between the front and rear of the ball as it travels through air.

BRIEF DESCRIPTION OF THE PRIOR ART

Numerous dimple configurations for use on golf balls are well-known in the patented prior art. The Kempshall U.S. Pat. No. 922,773, for example, discloses a golf ball having circular recesses in the surface thereof, with a central protuberance being arranged within each recess. In one embodiment, an outer band projects from the surface of the ball around each recess. The Kobayashi U.S. Pat. No. 4,787,638 discloses a golf ball having a plurality of first circular dimples formed in the outer shell of the ball and a plurality of secondary dimples arranged within the first dimples. This arrangement produces a turbulent air flow boundary layer at the surface of the ball when it travels at lower air speeds.

While these dimpled golf balls of the prior art differ from the more conventional circular dimpled balls, they have not achieved sufficient results as to attain acceptance in the marketplace. The present invention was developed in order to create a dimpled golf ball with improved flight characteristics which also conforms with U.S.G.A. standards.

SUMMARY OF THE INVENTION

Accordingly, it is a primary object of the present invention to provide a golf ball having a spherical surface with a plurality of uniquely configured dimples thereon. Each dimple includes an annular portion having an inner diameter and an outer diameter and a circular portion having a diameter corresponding with the inner diameter of the annular portion. At least one of the annular and circular portions extends above the surface of the golf ball.

According to a more particular object of the invention the annular portion of the dimple has a convex outer surface extending above the outer surface of the golf ball and the circular portion is concave and extends below the surface of the golf ball.

It is yet another object of the invention to provide a golf ball wherein the dimples comprise at least two groups. The first group of dimples each has an annular portion having a first outer diameter and the second group of dimples each as an annular portion having a second outer diameter.

BRIEF DESCRIPTION OF THE FIGURES

Other objects and advantages of the invention will become apparent from a study of the following specification when viewed in the light of the drawing, in which:

FIG. 2 is a detailed plan view of a dimple according to a preferred embodiment of the invention;

FIG. 3 is a sectional view taken along line 3—3 of FIG. 2;

FIG. 4 is a detailed plan view of an alternate dimple according to the invention; and FIG. 5 is a sectional view taken along line 5—5 of FIG. 4.

DETAILED DESCRIPTION

Figure 1:
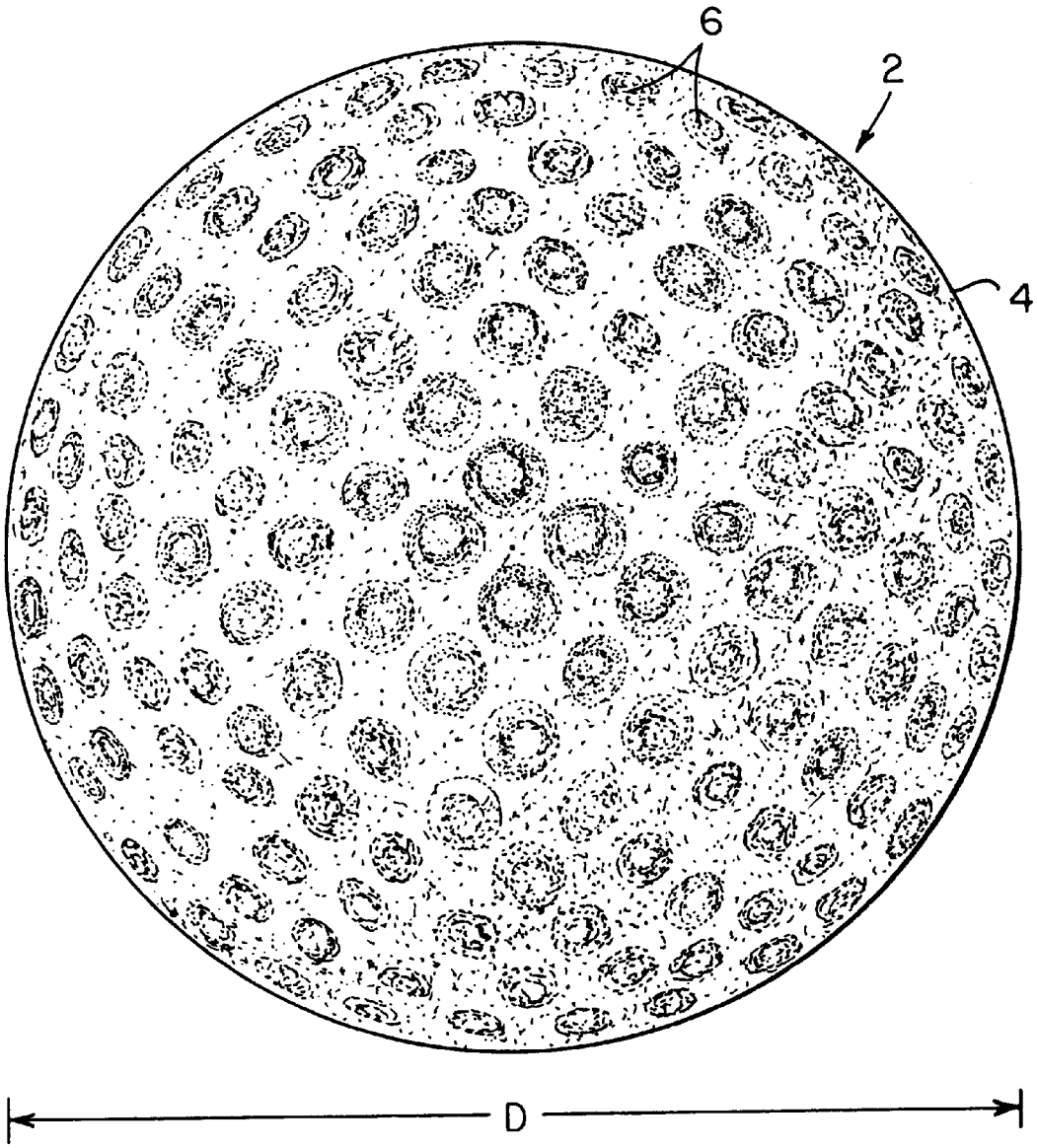
FIG. 1 is a plan view of a golf ball containing dimples with elevated portions according to the invention.

In FIG. 1 there is shown a golf ball 1 having a spherical surface 4 in which are formed a plurality of dimples 6. At least a portion of each dimple is elevated relative to the spherical surface as will be developed below.

Referring now to FIGS. 2 and 3, the preferred embodiment of the invention will be described. The dimple 6 comprises two portions, namely an outer annular portion 6*a* and an inner circular portion 6*b*. The annular portion 6*a* has an inner diameter $d_1$ and an outer diameter $d_2$, while the circular portion 6*b* has a diameter corresponding with the annular portion inner diameter $d_1$. The annular portion 6*a* has a convex outer surface which is elevated or raised with respect to the golf ball surface 4 as shown in FIG. 3. Moreover, the circular portion 6*b* has a concave outer surface which is depressed or extends either to or below the golf ball surface 4. Preferably, the radius of curvature of the circular portion is fixed.

The annular portion 6*a* which defines the outer edge of the dimple 6 is thus above the land area of conventional dimpled golf balls. This raised land area thus trips air flowing across the golf ball surface as the ball rotates through the air, thereby improving the aerodynamic properties of the ball. Where the concave circular portion 6*b* extends below the surface of the ball, the effect of the elevated annular portions 6*a* on the aerodynamics of the ball is enhanced.

Turning now to FIGS. 4 and 5, an alternate configuration for a dimple 106 according to the invention will be described. This configuration is essentially opposite that shown in FIGS. 2 and 3. That is, the annular portion 106*a* is concave and the circular portion 106*b* is convex and is elevated above the surface 104 of the golf ball 102 to trip air flowing across the ball surface. The inner diameter $d_1$ of the annular portion corresponds with the diameter of the circular portion. The annular portion may also extend below the golf ball surface as shown.

In order to comply with U.S.G.A. rules, the diameter of the golf ball including the dimples according to the invention, must have a diameter D of at least 1.680 inches. The diameter can be measured across the outer surface 4 of the golf ball of FIG. 1, whereby the dimples will include portions, either annular (FIGS. 2 and 3) or circular (FIGS. 4 and 5) which extend beyond the diameter. Thus, the diameter of the ball measured from the outermost dimple portions will be slightly greater than 1.680 inches. Alternatively, if the ball diameter is measured across the raised portions of the dimples, the diameter must be at least 1.680 inches. Thus, the ball diameter across the raised portions of the dimples must be at least 1.680 inches, but may be greater where the diameter is measured across the ball outer surface.

The dimples 6 may all have the same configuration and dimensions for the inner and outer diameters $d_1$ and $d_2$ of the annular portion. Alternatively, different sized dimples may be arranged on the ball. In FIG. 1, for example, there is shown a golf ball having a plurality of dimples of two different sizes. A first group of dimples A has an annular outer diameter less than that of a second group of dimples B. Any number of dimple sizes may be provided, and the number of dimples of each size need not be equivalent. This will facilitate the arrangement of dimples on the surface of the golf ball to maximize the percentage of dimple coverage on the ball. Dimples may also be provided having different inner diameters, whereby the widths of the annular portions among separate dimples will vary.

It is also possible to provide a golf ball with dimples of configurations of both FIGS. 3 and 5. That is, some dimples on a ball may have elevated annular portions and other dimples may have elevated center portions.

While in accordance with the provisions of the patent statutes, the preferred forms and embodiments of the invention have been illustrated and described, it will be apparent to those of ordinary skill in the art that various changes and modifications may be made without deviating from the inventive concepts set forth above.

What is claimed is:

1. A dimple in combination with a golf ball having a spherical surface, comprising (a) an annular portion having an inner diameter and an outer diameter; and (b) a circular portion having a diameter corresponding with said inner diameter of said annular portion, at least one of said annular and circular portions extending above the surface of the golf ball, whereby a golf ball containing a plurality of dimples in the surface thereof has improved flight characteristics.

2. A dimple as defined in claim 1, wherein the other of said annular and circular portions extends below the surface of the golf ball.

3. A dimple as defined in claim 2, wherein said annular portion has a convex outer surface extending above the surface of the golf ball and said circular portion is concave and extends below the surface of the golf ball.

4. A dimple as defined in claim 3, wherein said concave circular portion has a fixed radius of curvature.

5. A dimple as defined in claim 2, wherein said annular portion is concave and extends below the surface of the golf ball and said circular portion is convex and extends above the surface of the golf ball.

6. A golf ball having a spherical surface, comprising a plurality of dimples arranged in said surface, each of said dimples including (a) an annular portion having an inner diameter and an outer diameter; and (b) a circular portion having a diameter corresponding with said inner diameter of said annular portion, at least one of said annular and circular portions extending above the surface of the golf ball, whereby the golf has improved flight characteristics.

7. A golf ball as defined in claim 6, wherein all of said dimples have annular portions having the same outer diameter.

8. A golf ball as defined in claim 7, wherein all of said dimples have annular portions having the same inner diameter.

9. A golf ball as defined in claim 6, wherein said dimples comprise at least two groups of dimples, said first group of dimples each having a first annular outer diameter and said second group of dimples each having a second annular outer diameter different from said first outer diameter.

10. A golf ball as defined in claim 6, wherein none of said plurality of dimples overlap.

11. A golf ball as defined in claim 6, wherein the other of said annular and circular portions extends below the surface of the golf ball.

12. A golf ball as defined in claim 11, wherein said annular portion has a convex outer surface extending above the outer surface of the golf ball and said circular portion is concave and extends below the surface of the golf ball.

13. A golf ball as defined in claim 11, wherein said annular portion is concave and extends below the surface of the golf ball and said circular portion is convex and extends above the surface of the golf ball.

14. A golf ball as defined in claim 6, wherein the outer diameter of the golf ball at said annular portions is at least 1.680 inches.

* * * * *